US011771191B2

(12) United States Patent
Webb et al.

(10) Patent No.: US 11,771,191 B2
(45) Date of Patent: Oct. 3, 2023

(54) ODOR ELIMINATING EQUIPMENT BAG

(71) Applicants: Daniel Norris Webb, Los Angeles, CA (US); Charles J. Webb, Monument, CO (US)

(72) Inventors: Daniel Norris Webb, Los Angeles, CA (US); Charles J. Webb, Monument, CO (US)

(73) Assignee: 43 Degree Sports LLC, Edwards, CO (US)

( * ) Notice: Subject to any disclaimer, the term of this patent is extended or adjusted under 35 U.S.C. 154(b) by 232 days.

(21) Appl. No.: 17/096,233

(22) Filed: Nov. 12, 2020

(65) Prior Publication Data

US 2021/0145142 A1 May 20, 2021

Related U.S. Application Data

(60) Provisional application No. 62/936,054, filed on Nov. 15, 2019.

(51) Int. Cl.
*A45C 15/00* (2006.01)
*A45C 3/00* (2006.01)
(Continued)

(52) U.S. Cl.
CPC ..... *A45C 15/00* (2013.01); *A45C 3/00* (2013.01); *A45C 13/02* (2013.01); *D06F 58/14* (2013.01);
(Continued)

(58) Field of Classification Search
CPC .... H05B 3/34; H05B 3/20; H05B 3/36; A45C 2003/007; A45C 5/00; A45C 3/00;
(Continued)

(56) References Cited

U.S. PATENT DOCUMENTS 5,930,915 A 8/1999 Dhaemers
6,229,132 B1 5/2001 Knetter
(Continued)

FOREIGN PATENT DOCUMENTS

CA 2621579 A1 8/2009
CA 2653255 A1 8/2010
CN 108708148 A 10/2018

OTHER PUBLICATIONS

"Heated ski boot bag," URL: https://www.kulkea.com/product/heated-ski-boot-bag-thermal-trekker/; Accessed/Published: Aug. 19, 2019.

(Continued)

*Primary Examiner* — Corey N Skurdal
(74) *Attorney, Agent, or Firm* — DINSMORE & SHOHL LLP

(57) ABSTRACT

An equipment bag includes a shell comprising interior surfaces defining an interior volume defined by a first height, a first width, and a first length, where the shell comprises lengthwise portions forming a circumferential enclosure along the first length shell and two end portions positioned at opposite ends of the lengthwise portions enclosing the interior volume about the first height and the first width of the shell, a removable heating element, where the removable heating element includes heating panels defined by a second length and a second width, the second length corresponding to dimensions of a perimeter of the interior volume defined by the first width and the first height and the second width corresponding to the first length of the interior volume, and fasteners positioned at locations on interior surfaces of the shell such that the removable heating element is selectively attached to the interior surfaces of the shell.

20 Claims, 9 Drawing Sheets

(51) Int. Cl.

| | |
|---|---|
| ***A45C 13/02*** | (2006.01) |
| ***D06F 58/46*** | (2020.01) |
| ***D06F 58/14*** | (2006.01) |
| *D06F 105/28* | (2020.01) |
| *D06F 103/34* | (2020.01) |

(52) U.S. Cl.
CPC ..... *D06F 58/46* (2020.02); *A45C 2003/007* (2013.01); *D06F 2103/34* (2020.02); *D06F 2105/28* (2020.02)

(58) Field of Classification Search
CPC . A45C 7/00; F26B 9/003; F26B 9/006; F26B 9/06; F26B 3/18; F26B 3/20; F26B 23/04; A63B 47/005; A63B 2057/605; A63B 2225/64; D06F 58/30; D06F 59/02; D06F 58/14; D06F 58/26; D06F 58/266; D06F 57/00; D06F 58/00
See application file for complete search history.

(56) References Cited

U.S. PATENT DOCUMENTS

| | | | |
|---|---|---|---|
| 6,247,469 | B1 | 6/2001 | Guard |
| 7,325,679 | B2 | 2/2008 | Severe et al. |
| 8,141,268 | B2 | 3/2012 | Vezina et al. |
| 8,726,534 | B2 | 5/2014 | Chappell et al. |
| 2005/0127056 | A1 | 6/2005 | Petkov et al. |
| 2007/0227922 | A1 | 10/2007 | Chappell et al. |
| 2010/0051599 | A1 | 3/2010 | DeNitto |
| 2012/0210596 | A1 | 8/2012 | Lebel |
| 2018/0154028 | A1 | 6/2018 | Offutt et al. |
| 2019/0191835 | A1 | 6/2019 | Abramowitz et al. |

OTHER PUBLICATIONS

Drylocker, URL: http://www.drylockerhockey.com/, Accessed: Sep. 16, 2019.

Hockey World, Shock Doctor Powder Dry Wheeled Equipment Bag, URL: https://www.hockeyworld.com/Shock-Doctor-Power-Dry-Wheeled-Equipment-Bag-Senior, Accessed: Sep. 16, 2019.

Drysnake, Drysnake Hockey Bag, URL: https://drysnake.com/, Accessed: Sep. 16, 2019.

Rocketsport, Rocket Sport Dryer and Locker, URL: https://www.rocketsport.com/, Accessed: Sep. 16, 2019.

International Search Report and Written Opinion of the International Searching Authority, dated Feb. 5, 2021, PCT/US2020/60430.

ODOR ELIMINATING EQUIPMENT BAG

CROSS-REFERENCE TO RELATED APPLICATIONS

This application claims the benefit of U.S. Provisional Application No. 62/936,054 filed on Nov. 15, 2019, the entirety of which is hereby incorporated by reference.

TECHNICAL FIELD

The present specification generally relates to equipment bags for storing and transporting sporting equipment, and more specifically, to hockey bags having a heating element selectively attached to the lining of the hockey bag.

BACKGROUND

Sporting equipment, for example, hockey equipment is generally stored and transported in one or more bags. A bag provides the convenience of keeping all the equipment in one place and makes it easy to move from home, to a vehicle, to a rink, and home again. However, after equipment is used during practice or a game, the gear accumulates sweat, dirt, and other odor and bacteria causing ingredients. For example, hockey pads generally spend their time between practice and games in the equipment bag which becomes a breeding ground for odors and bacteria.

Accordingly, there is a need for an equipment bag configured to reduce or eliminate odor and bacteria while equipment is stored and/or transported in the equipment bag.

SUMMARY

In some embodiments, an equipment bag includes a shell comprising a plurality of interior surfaces defining an interior volume defined by a first height, a first width, and a first length, wherein the shell comprises one or more lengthwise portions forming a circumferential enclosure along the first length of the shell and two end portions positioned at opposite ends of the one or more lengthwise portions enclosing the interior volume about the first height and the first width of the shell, a selectively removable heating element, wherein the selectively removable heating element includes one or more heating panels defined by a second length and a second width, the second length corresponding to dimensions of a perimeter of the interior volume defined by the first width and the first height and the second width corresponding to the first length of the interior volume, and one or more fasteners positioned at one or more locations on the plurality of interior surfaces of the shell such that the selectively removable heating element is selectively attached to the plurality of interior surfaces of the shell.

In some embodiments, a system includes a controller comprising circuitry configured to control a selectively removable heating element, one or more sensors communicatively coupled to the controller, a shell comprising a plurality of interior surfaces defining an interior volume defined by a first height, a first width, and a first length, wherein the shell comprises one or more lengthwise portions forming a circumferential enclosure along the first length of the shell and two end portions positioned at opposite ends of the one or more lengthwise portions enclosing the interior volume about the first height and the first width of the shell, a selectively removable heating element, wherein the selectively removable heating element includes one or more heating panels defined by a second length and a second width, the second length corresponding to dimensions of a perimeter of the interior volume defined by the first width and the first height and the second width corresponding to the first length of the interior volume, and one or more fasteners, positioned at one or more locations on the plurality of interior surfaces of the shell such that the selectively removable heating element is selectively attached to the plurality of interior surfaces of the shell.

In some embodiments, a method of drying gear stored within an equipment bag includes installing a selectively removable heating element within an interior volume of a shell of the equipment bag, wherein the shell includes a plurality of interior surfaces defining the interior volume defined by a first height, a first width, and a first length, wherein the shell comprises one or more lengthwise portions forming a circumferential enclosure along the first length of the shell and two end portions positioned at opposite ends of the one or more lengthwise portions enclosing the interior volume about the first height and the first width of the shell; and activating the selectively removable heating element to generate heat, wherein the selectively removable heating element includes one or more heating panels defined by a second length and a second width, the second length corresponding to dimensions of a perimeter of the interior volume defined by the first width and the first height and the second width corresponding to the first length of the interior volume.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to an equipment bag for storing and transporting sporting equipment. More specifically, the present disclosure depicts and describes hockey bags for storing and transporting hockey gear including a uniform, skates, pads, and other gear. The hockey bag includes a heating element selectively attachable to the lining of the hockey bag. When the heating element is powered on, bacteria and odors are reduced and/or eliminated from the gear stored within the hockey bag by creating an enclosed envelope of heat around the interior volume of the hockey bad.

In some embodiments the lining of the hockey bag includes a heating element embedded therein. That is, the heating element may be configured to circumferentially enclose the length of the hockey bag such that a heating and drying zone is formed within the space enclosed by the heating element. In some embodiments, the heating element is configured within a heater sleeve. The heater sleeve may include fasteners such as Velcro, buttons, snaps or the like along portions of the heater sleeve. In some embodiments, fasteners may be directly incorporated with the heating element. The interior lining of the hockey bag includes opposing fastener elements for receiving the fasteners of the heater sleeve to the interior lining of the hockey bag. As such, the heating element may be selectively installed and removed by a user. For example, the heating element and heater sleeve may be removed for cleaning the hockey bag, the heating element, and/or the heater sleeve.

Additionally, the heating element includes a power source configured to attach to an AC wall plug. A temperature controller may be included along the power supply line of the heating element. The temperature controller includes one or more selectable "ON" states. Each "ON" state may define a different temperature or temperature range in order to achieve warming, drying, and/or bacteria killing functionality of the gear within the hockey bag.

Figure 1A:
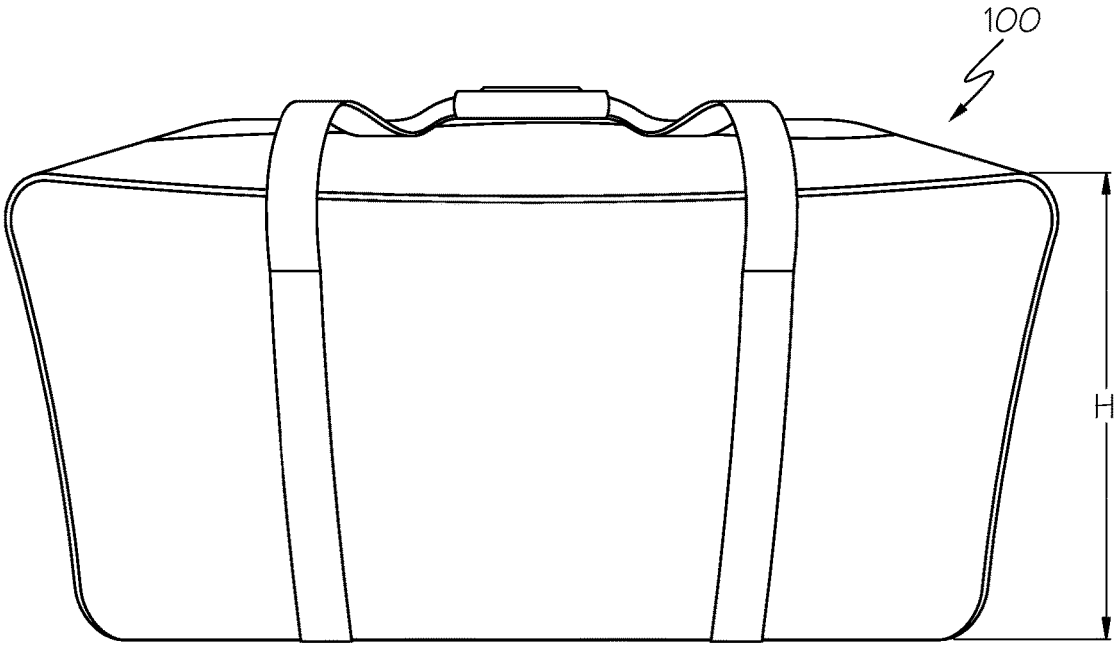
FIG. 1A depicts a side view of an example equipment bag, according to one or more embodiments shown and described herein.
Figure 1B:
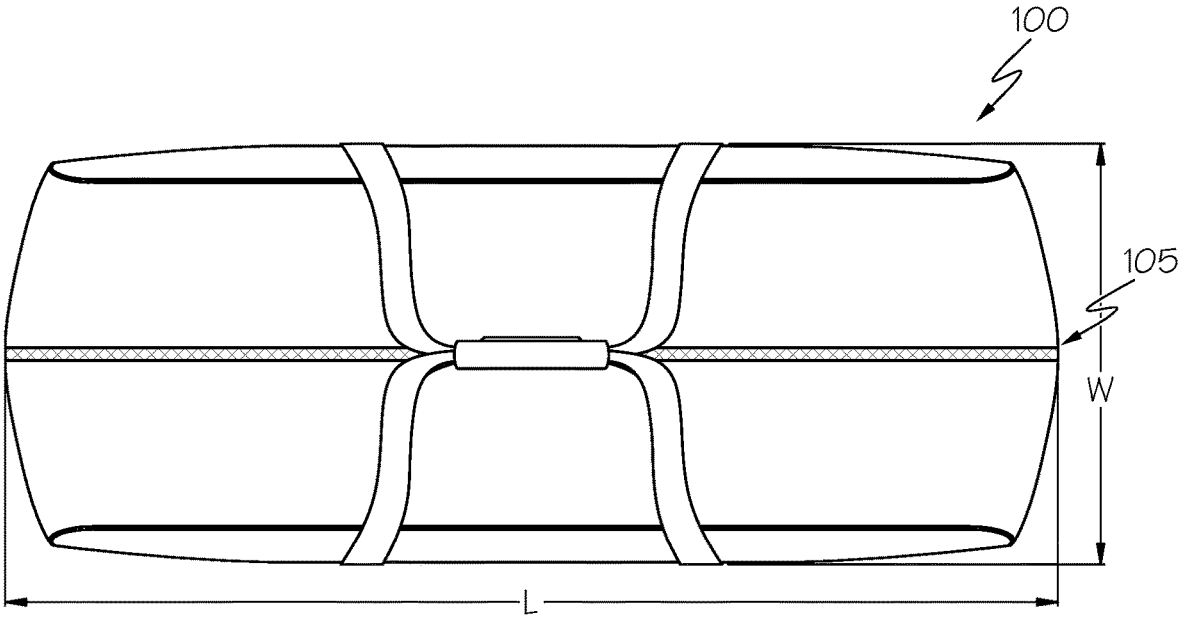
FIG. 1B depicts a top view of the example equipment bag of FIG. 1A, according to one or more embodiments shown and described herein.

Turning now to the drawings wherein like numbers refer to like structures, and particularly to FIGS. 1A-1G where various views of an example hockey bag 100 are depicted. FIG. 1A depicts a side view of the example hockey 100 and FIG. 1B depicts a top view of the example hockey bag 100. The hockey bag 100 may include a zipper or other fastening means for selective opening and closing of the hockey bag 100 to access the storage space therein. In some embodiments, a zipper may run lengthwise along the hockey bag 100 as depicted in FIG. 1A. However, this is only one example. Some hockey bags 100 may have two or more zippers allowing for a panel to be selectively removed for accessing the storage space of the hockey bag 100.

Additionally, it should be understood the hockey bag 100 may have interior dimensions (e.g., height "H", length "L", width "W") such that gear, including but not limited to sweats, uniforms, skates, pads, socks, and other gear, may be stored and transported therein. In some embodiments, a hockey bag 100 may have an interior H×L×W of 19 inches×36 inches×17 inches. The interior dimensions define an interior volume. However, this is only one example. The dimensions of a hockey bag 100 generally depend on the type and size of the gear they are intended to store and transport. For example, a youth hockey bag may have dimensions smaller than that of an adult hockey bag, since youth gear is smaller than adult gear. A goal keeper's hockey bag may be larger than hockey bags for other players because a goal keeper's pads and other gear are larger.

Figure 1C:
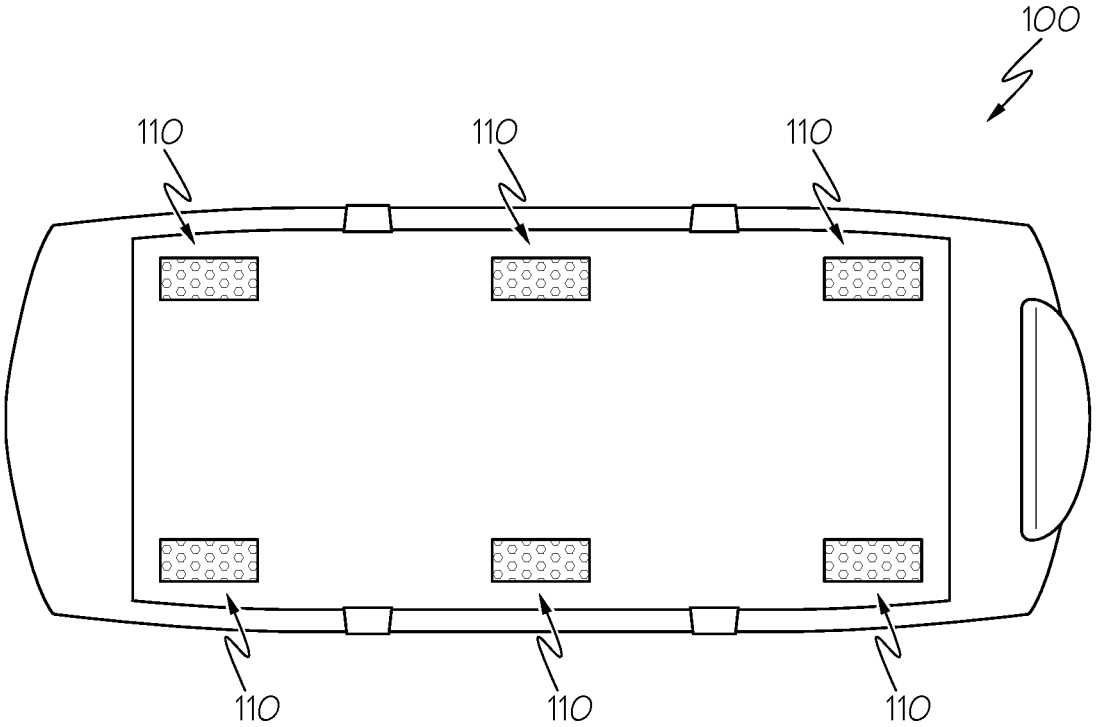
FIG. 1C depicts a bottom view of the example equipment bag, according to one or more embodiments shown and described herein.

Referring now to FIG. 1C, the bottom of the hockey bag 100 is depicted. The bottom of a hockey bag may include rollers, skids, or feet 105 to keep the base fabric of the hockey bag from wearing out. However, this is only an example as other embodiments of a hockey bag 100 may include other features on the bottom of the bag to improve durability and/or transportation.

Figure 1D:
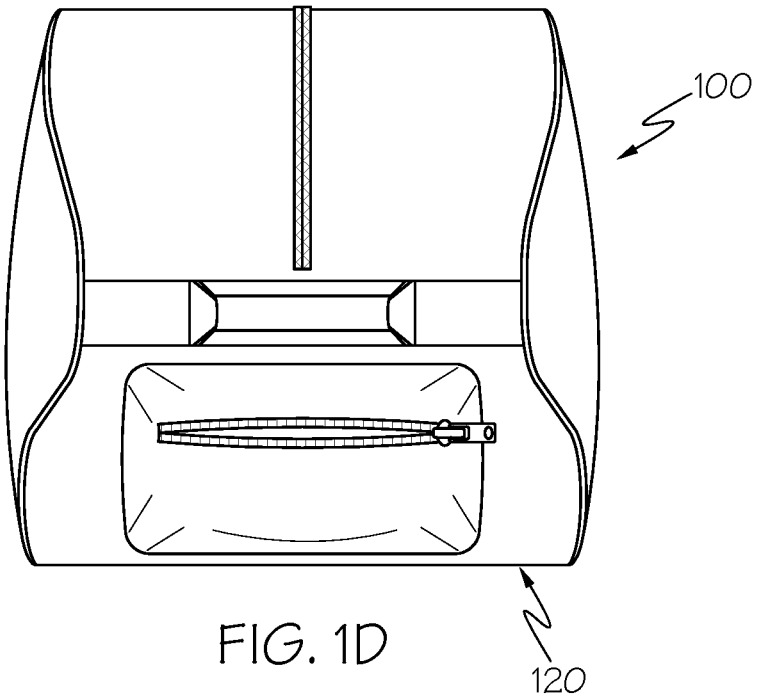
FIG. 1D depicts a first end view of the example equipment bag of FIG. 1A, according to one or more embodiments shown and described herein.
Figure 1E:
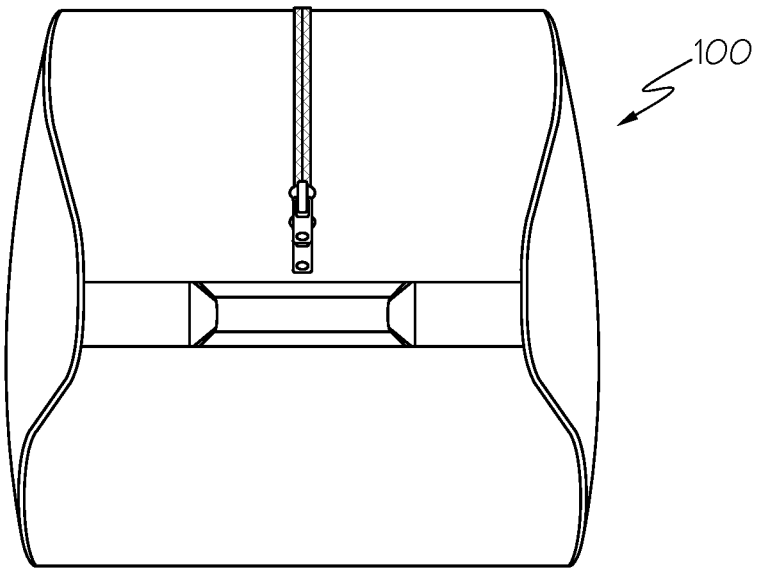
FIG. 1E depicts a second end view of the example equipment bag of FIG. 1A, according to one or more embodiments shown and described herein.

FIGS. 1D and 1E depict opposing ends of the hockey bag 100. In some embodiments, each end of the hockey bag may include a pocket for storing gear such as a uniform, gloves, or the like. In FIG. 1D a pocket 120 is included on the end of the hockey bag 100 for storing the wire and the controller for the heating element. The pocket 120 is accessible by way of a zipper or other closure device. The pocket 120 may further include holes or slots (not shown) for feeding the wires from the heating element installed within the interior of the hockey bag 100 into the pocket 120. The hole or slot in the shell of the hockey bag 100 that is configured to feed one or more wires through to power the heating element may include a fitting such as gasket or other material fitted to fill any space between the one or more wires and the shell of the hockey bag 100. In some embodiments, the shell around where the hole or slot is formed may include additional stitching to reinforce and form a tight fit with the one or more wires positioned through the hole or slot. The inclusion of a fitting or additional stitching around the hole or slot is configured to prevent or reduce air flow into or out of the hockey bag 100. Accordingly, the temperature within the bag may be maintained in a more efficient manner since the hockey bag 100, when closed, does not permit or at least minimizes the air flow through the interior. Furthermore, the pocket 120 allows a user to remove a portion of the wire and connect it to an outlet to provide power to the heating element. In some embodiments, the heating element may be powered by a battery pack. The battery pack may be stored in the pocket 120.

Figure 1F:
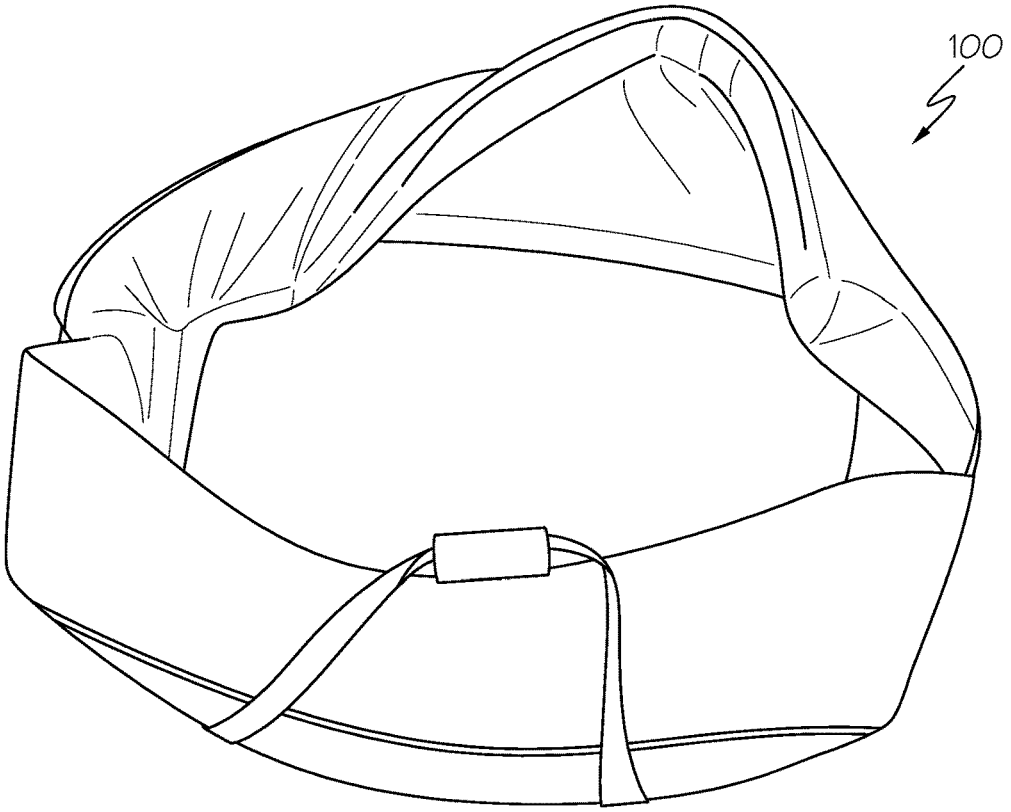
FIG. 1F depicts the example equipment bag of FIG. 1A in an open state, according to one or more embodiments shown and described herein.
Figure 1G:
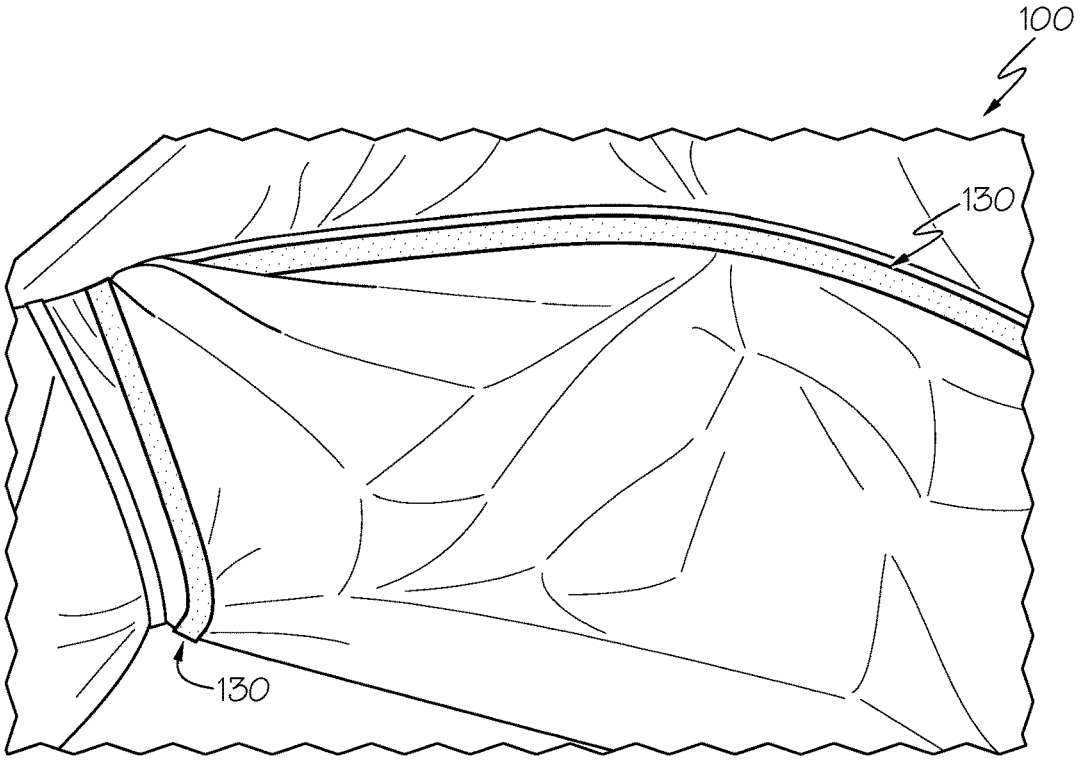
FIG. 1G depicts an example interior of the example equipment bag of FIG. 1A, according to one or more embodiments shown and described herein.

FIG. 1F depicts the hockey bag 100 from a top view where the zipper is in an open position such that the storage space of the hockey bag 100 is accessible. The storage space of the hockey bag 100 may be compartmentalized such that specific gear has a defined location for storage and transportation or the storage space may be an open volume for placing gear anywhere therein. FIG. 1G is a figure depicting in greater detail the interior lining of the hockey bag 100. The interior lining may include one or more fasteners 130 for fastening a heating element liner 300 (depicted and described with reference to FIG. 3) having a heating element 200 (depicted and described with reference to FIG. 2) installed therein to the interior lining of the hockey bag 100. For example, FIG. 1G depicts strips of Velcro as the fastener 130 attached to the interior lining of the hockey bag 100.

Figure 2:
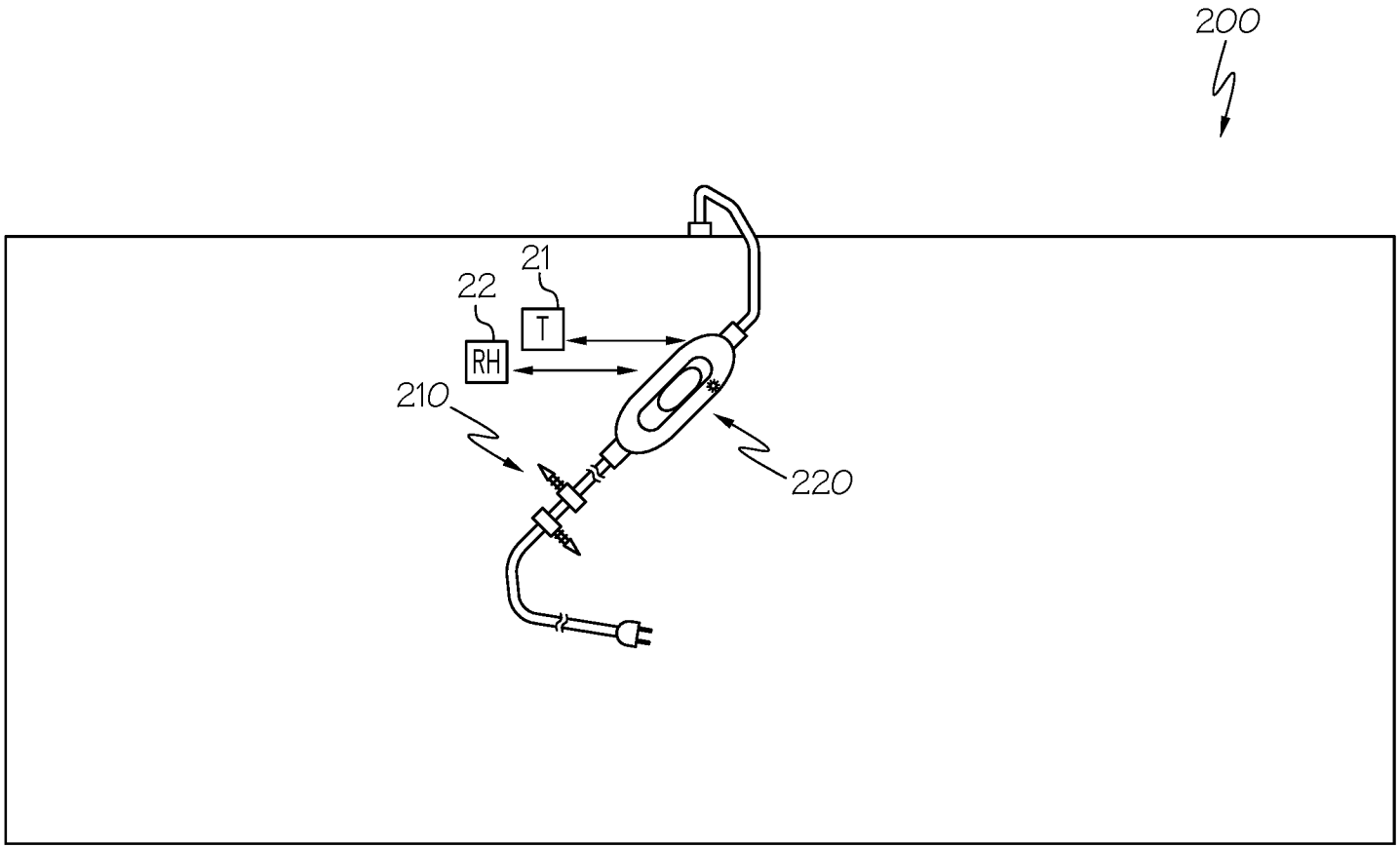
FIG. 2 depicts an example heating element, according to one or more embodiments shown and described herein.
Figure 4:
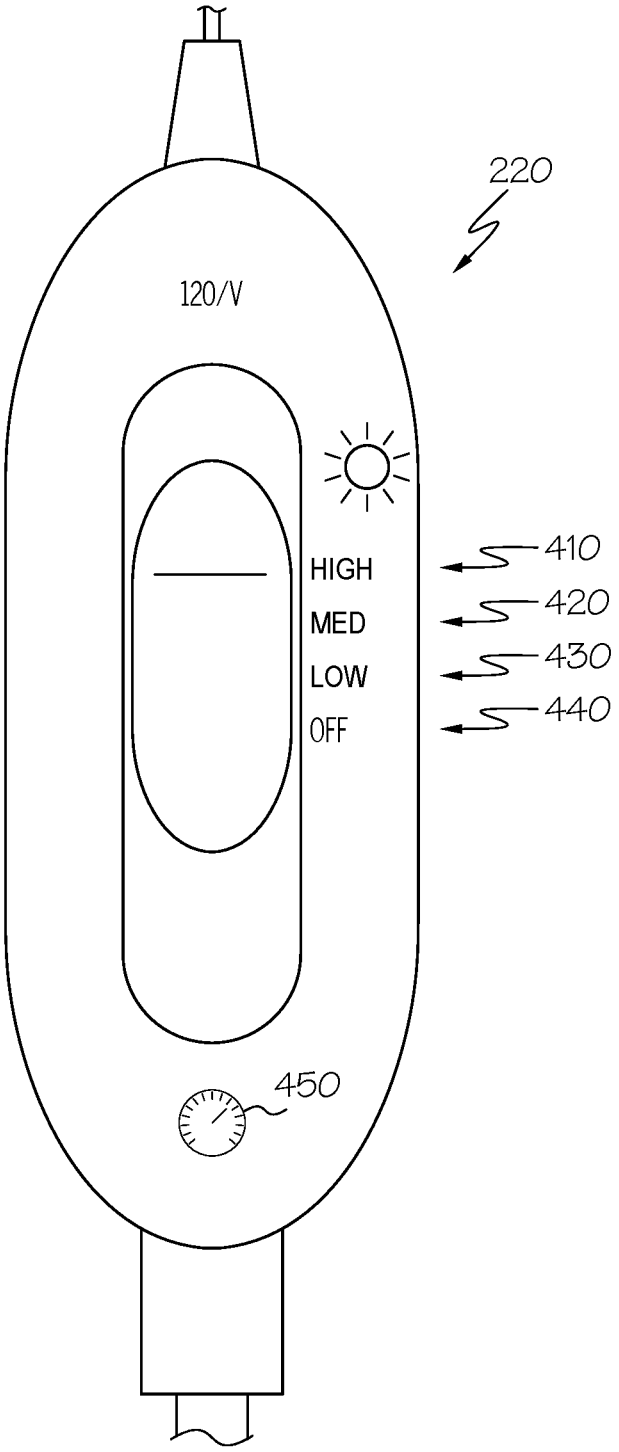
FIG. 4 depicts an example control device for controlling the heat level generated by the heating element, according to one or more embodiments shown and described herein.

Turning to FIG. 2, an example heating element 200 not installed in a hockey bag 100 is depicted. The heating element 200 may be any device capable of converting electrical or chemical energy into thermal energy to generate radiant heat. A heating element 200 generally includes wires 210 for coupling to an electric power source to a heat generating device within the heating element 200. The heat generating device may be a coil of wires and/or a resistive device causing current from the electric power source to convert electrical energy from the electric power source to thermal energy. The controller 220 may be coupled with the wires 210 and the heat generating device of the heating element 200 to regulate the amount of heat that is generated by the heating element 200. Referring briefly to FIG. 4, a controller 220 may include a multi-position switch whereby toggling the switch between preset positions regulates the amount of thermal energy generated by the heating element 200. The controller 220 includes circuitry configured to control a temperature output of the heating element 200. The circuitry may include timer circuitry, power distribution and control circuitry, programmable circuitry for presetting and/or monitoring and controlling the temperature output of the heating element 200 based on one or more signals from the one or more sensors 21, 22 for monitoring conditions within the hockey bag (e.g., a temperature sensor 21, a humidity sensor 22, or the like). For example, the controller 220 depicted in FIG. 4 includes a four position switch. A first position 410 sets the heating element 200 at the maximum level output, a second position 420 sets the heating element 200 at a moderate level output, and a third position 430 sets the heating element 200 at a low level output. Each of the positions 410, 420, and 430 correspond to an "ON" state of the heating element 200. A fourth position 440 sets the heating element 200 to an "OFF" state where no heat is generated. In some embodiments, the controller 220 may include a timer 450. The timer 450 may be used to schedule intervals of heating at various temperatures whereby the gear within the bag will be heated. For example, but without limitation the timer 450 and the controller 220 may be configured such that the maximum level of heat may be set for 1 hour, followed by a moderate level of heat for 4 hours, followed by a low level of heat for 4 hours, then further programed to shut off the heating element. This is only one example, and it should be understood that other programed temperature sequences may be implemented. That is, a controller can be programmed to provide heat to the gear within the hockey bag 100 through a programmed sequence of temperatures. In some instances, depending on how wet the gear is and/or how fast a user wants the gear to dry, a different heating setting may be used.

In some embodiments, a controller 220 may be communicatively coupled to one or more sensors 21, 22 for monitoring humidity, temperature, and/or other condition within the hockey bag 100. The controller 220 may be configured to regulate the temperature within the hockey bag to reduce the humidity level within the hockey bag 100. For example, when the humidity level is determined to be greater than 50, 60, 70, 75, 80, 85, 90, or 95 percent, the controller 220 may activate the heating element 200 to increase the temperature within the hockey bag. As the humidity level is detected to decrease by a predefined percentage or reach a predetermined humidity level, then the controller 220 may reduce and/or deactivate the heating element 220. The one or more sensors 21, 22 may be coupled to the heating elements such that they are also removable from the hockey bag as a user desires.

The maximum heating level, for example, corresponds to a temperature greater than 140 degrees Fahrenheit in order to destroy or reduce the amount of bacteria present within the gear. That is, most microbial cells will die at a temperature of 100 degrees Fahrenheit or more, but some bacterial spores can survive up to temperatures of 130 to 140 degrees Fahrenheit. Therefore, temperatures at or greater than that range may be generated in order to dry and kill bacteria living in and on the gear stored in the hockey bag.

Figure 3:
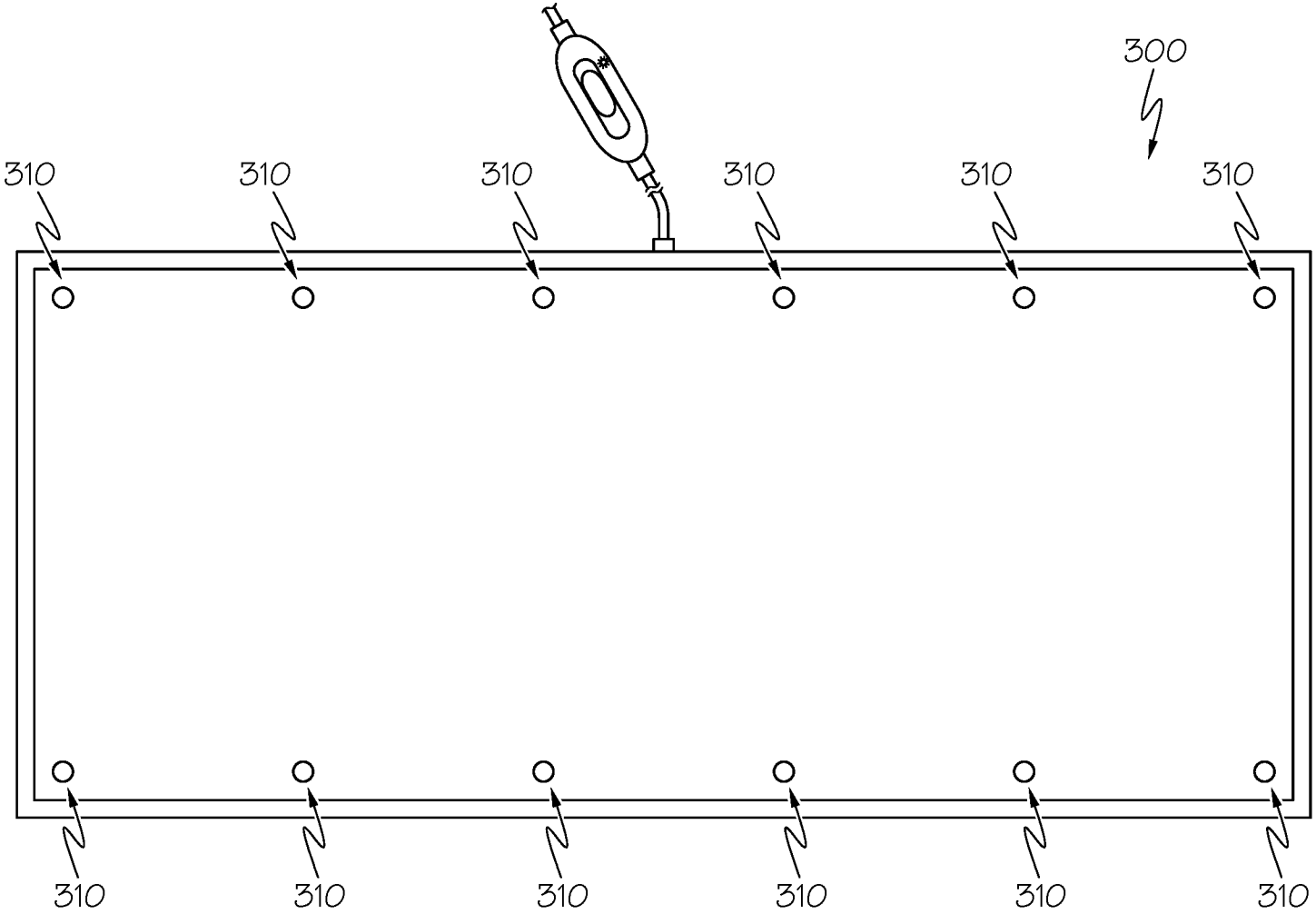
FIG. 3 depicts an example heating element liner having a heating element installed therein, according to one or more embodiments shown and described herein.

Referring to FIG. 3, an example heating element liner 300 having a heating element 200 installed therein is depicted. In embodiments, the hearing element 200 is installed within the heating element liner 300 and the heating element liner 300 is selectively fastened to the interior lining of the hockey bag 100. The heating element liner 300 is selectively fastened to the interior lining of the hockey bag 100 by way of one or more fastening devices 310. For example, as suggested above, the one or more fastening devices 310 may include Velcro, buttons, snaps, or other means of selectively fastening two materials with each other. The heating element liner 300 may be moisture resistant or waterproof so that sweat and wet gear does not negatively affect the heating element 200. Additionally, the heating element liner 300 may be washable. Therefore, the heating element 200 must be capable of being removed from the heating element liner 300. In some embodiments, the heating element liner 300 may include an insulating material on one side, for example, an exterior facing surface (e.g., the surface between the heating element 200 and the hockey bag 100). The insulating material may increase the temperature control (e.g., help maintain the temperature at a predefined value) within the hockey bag.

Figure 5:
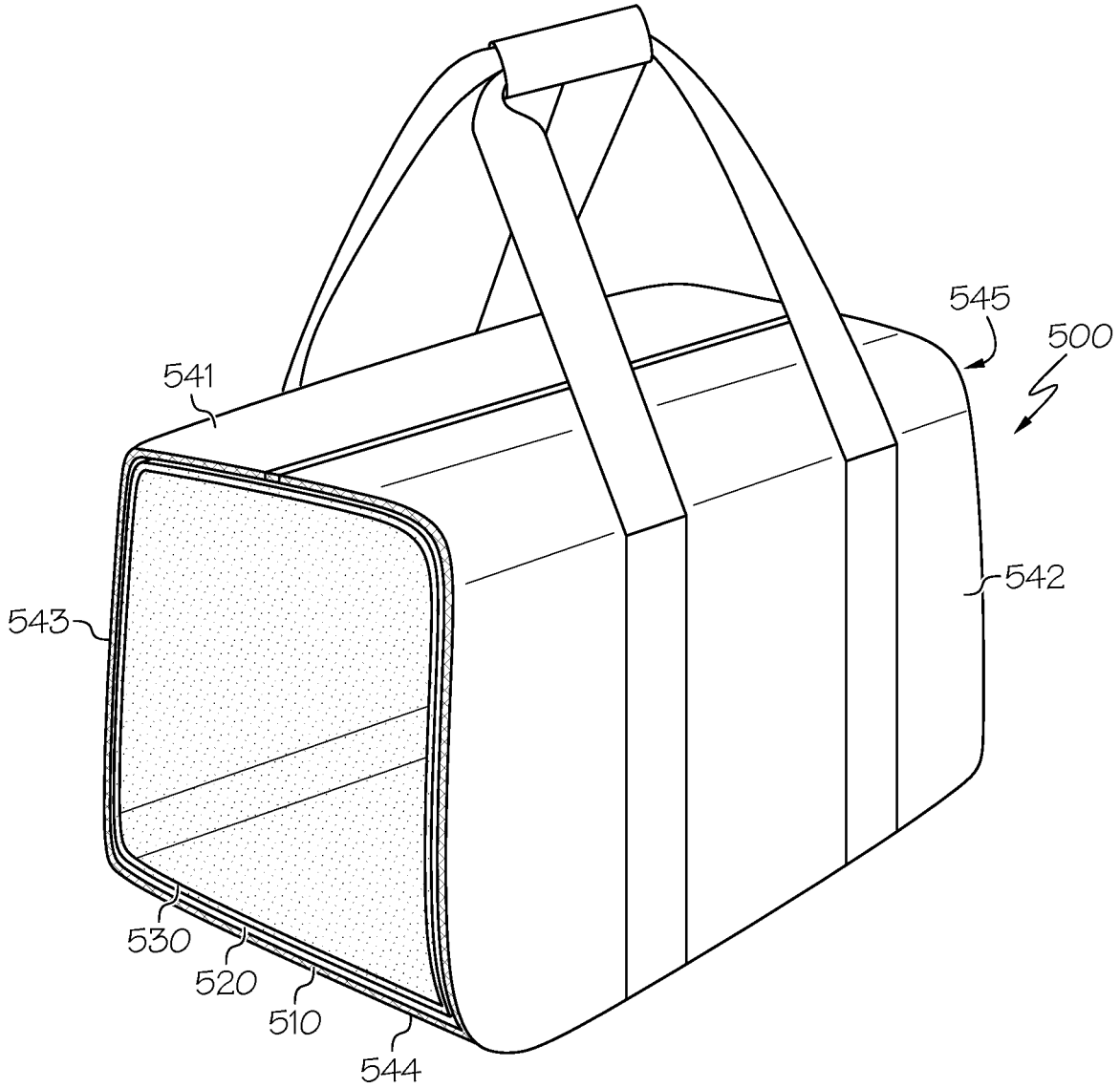
FIG. 5 depicts an illustrative cross-section of an example bag from the first end view, according to one or more embodiments shown and described herein.

Turning to FIG. 5, an illustrative cross-section of an example hockey bag 500 from a first end view is depicted. The hockey bag 500 in its most basic form includes a shell 510 forming the structure of the hockey bag 500. The shell 510 may include one or more materials including, for example, an insulating material to assist with generating a heated volume within the interior of the hockey bag 500. Additionally, a heating element 530 may be enclosed within a heating element liner 520 and fastened to one or more of the interior surfaces of the hockey bag 500. The inventors have discovered that by positioning the heating element 530 along at least the lengthwise portions 541, 542, 543, and 544 of the hockey bag 500 (e.g., forming a circumferential enclosure along the length of the shell) a heated volume may be formed thereby efficiently drying the gear, reducing odors emitted by the gear, and killing bacteria. In some embodiments, the heating element 530 may not only be positioned along each of the lengthwise portions 541, 542, 543, and 544, but may also include portions positioned to correspond with the ends 545 of the hockey bag. In such an embodiment, the heating element may cover nearly all of the interior lining of the hockey bag 500.

In some embodiments, a method of assembling and using the heating element 530 within the shell 510 of the hockey bag 500 may include installing the heating element 530 (e.g., a selectively removable heating element) within an interior volume of a shell of the hockey bag 500 (i.e., the equipment bag) by attaching one or more fasteners positioned on the heating element 530 (or in some embodiments on the liner of the heating element 530) with corresponding fasteners positioned within the interior of the shell 510 of the hockey bag.

The shell 510 includes a plurality of interior surfaces defining the interior volume defined by a first height, a first width, and a first length. The shell 510 includes one or more lengthwise portions forming a circumferential enclosure along the first length of the shell and two end portions positioned at opposite ends of the one or more lengthwise portions enclosing the interior volume about the first height and the first width of the shell. The method further includes activating the heating element 530 from a control signal provided by the controller 200 to generate heat at a predetermined temperature and optionally for a predetermined time or until a predetermined humidity value or temperature value is reached. As described herein, the heating element 530 includes one or more heating panels defined by a second length and a second width, the second length corresponding to dimensions of a perimeter of the interior volume defined by the first width and the first height and the second width corresponding to the first length of the interior volume.

Figure 6A:
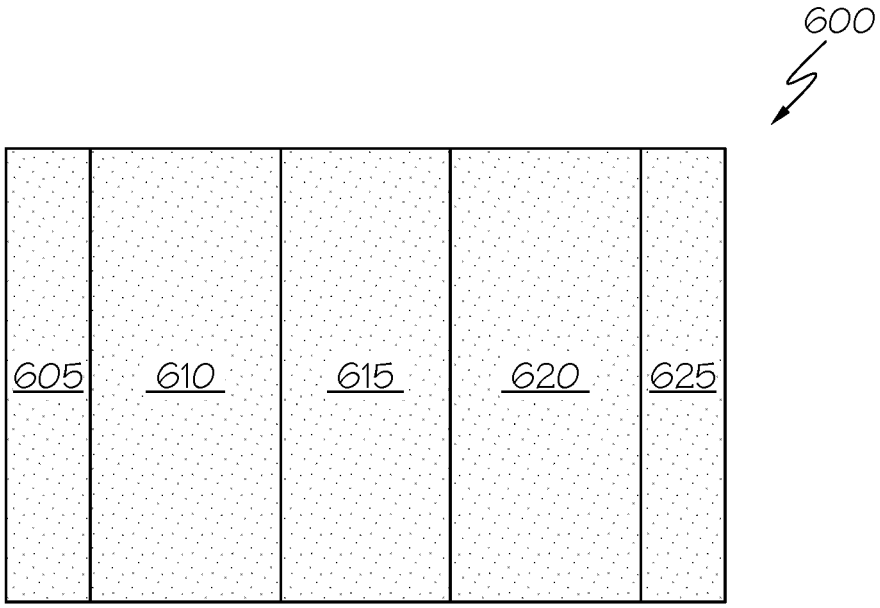
FIG. 6A depicts an illustrative layout of a heating element, according to one or more embodiments shown and described herein.
Figure 6B:
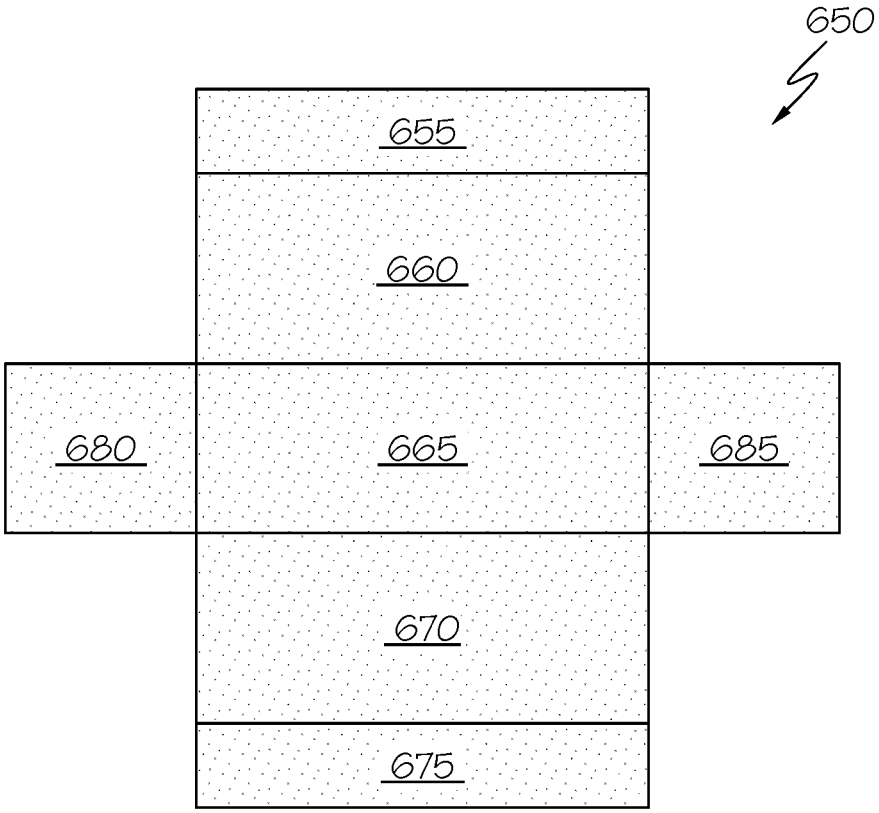
FIG. 6B depicts an illustrative layout of another heating element, according to one or more embodiments shown and described herein.

FIGS. 6A and 6B depict example two-dimensional designs of the two variations of heating elements 530 described with reference to FIG. 5. For example FIG. 6A depicts a heating element 600 having heating panels 605, 610, 615, 620, and 625 each respectively corresponding to a first top portion, a first side portion, a bottom portion, a second side portion opposite a first side portion, and a second top portion of a hockey bag. The first and second top portions may be configured to correspond to the type of opening the hockey bag is designed to implement. That is, the heating element 600 is shown for implementation with a hockey bag consistent to the one depicted in FIGS. 1A-1G where the zipper for accessing the storage volume is positioned along a centerline of the top of the hockey bag 100.

However, the heating element 600 does not include heating portions that correspond to the first and second ends of the hockey bag 100 as depicted in FIGS. 1D and 1E. FIG. 6B depicts another illustrative layout of another heating element 650. The heating element 650 includes heating panels 655, 660, 665, 670, 675, 680, and 685 each of which corresponds to a first top portion, a first side portion, a bottom portion, a second side portion opposite a first side portion, a second top portion, a first end and a second end opposite the first end of a hockey bag, respectively.

By forming an enclosed volume with a heating element 600 or heating element 650, the inventors discovered that gear stored within the storage volume that is heated is efficiently dried and odors and bacteria are reduced and/or eliminated. It should now be understood that embodiments depicted in the figures and described herein relate to a hockey bag having a heating element that is selectively attachable to the lining of the hockey bag, where the heating element is configured to circumferentially enclose the length of the hockey bag such that a heating and/or drying zone is formed within the space enclosed by the heating element.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An equipment bag comprising:

a shell comprising a plurality of interior surfaces defining an interior volume defined by a first height, a first width, and a first length, wherein the shell comprises one or more lengthwise portions forming a circumferential enclosure along the first length of the shell and two end portions positioned at opposite ends of the one or more lengthwise portions enclosing the interior volume about the first height and the first width of the shell;

a selectively removable heating element positioned within the interior volume of the shell and lining the circumferential enclosure along the first length of the shell thereby forming a circumferential enclosed envelope of heat within the interior volume of the shell effecting heating, drying, and bacteria reduction of equipment positioned within the circumferential enclosed envelope of heat, wherein the selectively removable heating element includes one or more heating panels defined by a second length and a second width, the second length corresponding to dimensions of a perimeter of the interior volume defined by the first width and the first height, and the second width corresponding to the first length of the interior volume; and one or more fasteners positioned at one or more locations on the plurality of interior surfaces of the shell such that the selectively removable heating element is selectively attached to the plurality of interior surfaces of the shell.

2. The equipment bag of claim 1, wherein the selectively removable heating element further comprises one or more additional heating panels with dimensions corresponding to the two end portions of the shell.

3. The equipment bag of claim 1, wherein when the selectively removable heating element is installed within the interior volume of the shell and the selectively removable heating element is activated, the interior volume of the shell is heated by the selectively removable heating element about the perimeter of the interior volume.

4. The equipment bag of claim 1, further comprising a liner, wherein the selectively removable heating element is contained within the liner and the liner includes one or more mating fasteners corresponding to the one or more fasteners positioned at the one or more locations on the plurality of interior surfaces of the shell.

5. The equipment bag of claim 1, further comprising a controller comprising circuitry configured to control a temperature output of the selectively removable heating element.

6. The equipment bag of claim 5, wherein the controller comprises a multi-position switch, where at least one position causes the selectively removable heating element to generate heat a first level and at least one other position causes the selectively removable heating element to not generate heat.

7. The equipment bag of claim 5, wherein the controller comprises a timer, wherein the timer causes the selectively removable heating element to generate heat for a predetermine amount of time based on the timer.

8. The equipment bag of claim 5, further comprising one or more sensors communicatively coupled to the controller, wherein the circuitry of the controller is configured to regulate the heat generated by the selectively removable heating element in response to one or more sensor signals received by the controller from the one or more sensors.

9. The equipment bag of claim 8, wherein:

the one or more sensors include a humidity sensor, the circuitry of the controller is configured to activate the selectively removable heating element to generate heat when the humidity sensor indicates a humidity within the interior volume is equal to or greater than a predetermined humidity value, and the circuitry of the controller is configured to deactivate the selectively removable heating element from generating heat when the humidity sensor indicates the humidity within the interior volume is less than a predetermined humidity value.

10. The equipment bag of claim 8, wherein:

the one or more sensors include a temperature sensor, the circuitry of the controller is configured to activate the selectively removable heating element to generate heat when the temperature sensor indicates a temperature within the interior volume is less than a predetermined temperature value, and the circuitry of the controller is configured to deactivate the selectively removable heating element from generating heat when the temperature sensor indicates the temperature within the interior volume is equal to or greater than a predetermined temperature value.

11. The equipment bag of claim 1, further comprising a power adapter electrically coupled to the selectively removable heating element, wherein the power adapter is at least one of an alternating current power adapter or a cigarette lighter adapter.

12. The equipment bag of claim 1, further comprising a battery electrically coupled to the selectively removable heating element for powering the selectively removable heating element.

13. The equipment bag of claim 1, wherein the one or more fasteners include at least one of a hook and loop type fastener, a snap fastener, a magnetic type fastener, a zipper type fastener, or a Velcro type fastener.

14. A system comprising:

a controller comprising circuitry configured to control a selectively removable heating element;

one or more sensors communicatively coupled to the controller;

a shell comprising a plurality of interior surfaces defining an interior volume defined by a first height, a first width, and a first length, wherein the shell comprises one or more lengthwise portions forming a circumferential enclosure along the first length of the shell and two end portions positioned at opposite ends of the one or more lengthwise portions enclosing the interior volume about the first height and the first width of the shell;

the selectively removable heating element positioned within the interior volume of the shell and lining the circumferential enclosure along the first length of the shell thereby forming a circumferential enclosed envelope of heat within the interior volume of the shell effecting heating, drying, and bacteria reduction of equipment positioned within the circumferential enclosed envelope of heat, wherein the selectively removable heating element includes one or more heating panels defined by a second length and a second width, the second length corresponding to dimensions of a perimeter of the interior volume defined by the first width and the first height and the second width corresponding to the first length of the interior volume; and one or more fasteners, positioned at one or more locations on the plurality of interior surfaces of the shell such that the selectively removable heating element is selectively attached to the plurality of interior surfaces of the shell.

15. The system of claim 14, wherein the controller comprises a timer, wherein the timer causes the selectively removable heating element to generate heat for a predetermine amount of time based on the timer.

16. The system of claim 14, wherein the circuitry of the controller is configured to regulate the heat generated by the selectively removable heating element in response to one or more sensor signals received by the controller from the one or more sensors.

17. The system of claim 16, wherein:

the one or more sensors include a humidity sensor, the circuitry of the controller is configured to activate the selectively removable heating element to generate heat when the humidity sensor indicates a humidity within the interior volume is equal to or greater than a predetermined humidity value, and the circuitry of the controller is configured to deactivate the selectively removable heating element from generating heat when the humidity sensor indicates the humidity within the interior volume is less than a predetermined humidity value.

18. The system of claim 16, wherein:

the one or more sensors include a temperature sensor, the circuitry of the controller is configured to activate the selectively removable heating element to generate heat when the temperature sensor indicates a temperature within the interior volume is less than a predetermined temperature value, and the circuitry of the controller is configured to deactivate the selectively removable heating element from generating heat when the temperature sensor indicates the temperature within the interior volume is equal to or greater than a predetermined temperature value.

19. The system of claim 14, further comprising a power adapter electrically coupled to the controller and the selectively removable heating element, wherein the power adapter is at least one of an alternating current power adapter or a cigarette lighter adapter.

20. A method of drying gear stored within an equipment bag, the method comprising:

installing a selectively removable heating element within an interior volume of a shell of the equipment bag, wherein the shell includes a plurality of interior surfaces defining the interior volume defined by a first height, a first width, and a first length, wherein the shell comprises one or more lengthwise portions forming a circumferential enclosure along the first length of the shell and two end portions positioned at opposite ends of the one or more lengthwise portions enclosing the interior volume about the first height and the first width of the shell; and activating the selectively removable heating element to generate heat, wherein the selectively removable heating element is positioned within the interior volume of the shell and lining the circumferential enclosure along the first length of the shell thereby forming a circumferential enclosed envelope of heat within the interior volume of the shell effecting heating, drying, and bacteria reduction of equipment positioned within the circumferential enclosed envelope of heat, wherein the selectively removable heating element includes one or more heating panels defined by a second length and a second width, the second length corresponding to dimensions of a perimeter of the interior volume defined by the first width and the first height and the second width corresponding to the first length of the interior volume.

* * * * *